US011717734B2

(12) United States Patent
De Goyeneche Parker et al.

(10) Patent No.: US 11,717,734 B2
(45) Date of Patent: Aug. 8, 2023

(54) SLIDING PUCK MULTIPLAYER GAME WITH ADJUSTABLE DIFFICULTY

(71) Applicants: Alfredo De Goyeneche Parker, Santiago (CL); Alfredo Sebastián De Goyeneche Macaya, Santiago (CL)

(72) Inventors: Alfredo De Goyeneche Parker, Santiago (CL); Gonzalo Andrés Ríos Díaz, Santiago (CL); Alfredo Sebastián De Goyeneche Macaya, Santiago (CL)

(73) Assignees: Alfredo De Goyeneche Parker, Santiago (CL); Alfredo Sebastián De Goyeneche Macaya, Santiago (CL)

( * ) Notice: Subject to any disclaimer, the term of this patent is extended or adjusted under 35 U.S.C. 154(b) by 130 days.

(21) Appl. No.: 17/363,961

(22) Filed: Jun. 30, 2021

(65) Prior Publication Data

US 2023/0001277 A1 Jan. 5, 2023

(51) Int. Cl.

| | |
|---|---|
| ***A63B 67/14*** | (2006.01) |
| ***A63F 7/00*** | (2006.01) |
| ***A63F 7/06*** | (2006.01) |
| ***A63F 7/30*** | (2006.01) |
| ***A63F 7/36*** | (2006.01) |

(52) U.S. Cl.

CPC ..... *A63B 67/14* (2013.01); *A63F 7/0005* (2013.01); *A63F 7/0632* (2013.01); *A63F 2007/3015* (2013.01); *A63F 2007/3662* (2013.01)

(58) Field of Classification Search

CPC ..... A63B 67/14; A63F 7/0005; A63F 7/0632; A63F 2007/3015; A63F 2007/3662; A63F 7/2481; A63F 2007/4018; A63F 2007/4068; A63F 2011/0076; A63F 2250/124

See application file for complete search history.

(56) References Cited

U.S. PATENT DOCUMENTS 3,403,911 A * 10/1968 Horst ..... A63B 67/14 273/127 R
3,762,711 A * 10/1973 Cooper ..... A63F 7/0005 273/DIG. 26
3,907,294 A * 9/1975 Breslow ..... A63F 7/0005 473/109
3,954,267 A 5/1976 Freeman et al.
4,502,686 A * 3/1985 Liams, Jr. ..... A63F 7/0017 473/109

(Continued)

*Primary Examiner* — Michael D Dennis

(74) *Attorney, Agent, or Firm* — Procopio, Cory, Hargreaves & Savitch LLP

(57) ABSTRACT

The present invention relates to the technical field of hockey-type table games, in particular to a game in which pucks are projected across a playing surface by means of a compression system that can be operated with the fingers of one hand and which aims to insert said pucks into a goal. Specifically, it provides a sliding puck multiplayer game having the possibility of adjusting the difficulty of the game and the number of players, characterized in that it comprises: a polygonal-shaped modular platform; a plurality of interchangeable connector bridges of different sizes that are connected to said modular platform; and a plurality of sliding pucks that are propelled by the effect of said elastic band, to go through said connecting bridges. In this way, it is possible to obtain a sliding puck game that allows a greater number of players simultaneously, with adjustable difficulty, portable and modular.

10 Claims, 3 Drawing Sheets

(56) References Cited

U.S. PATENT DOCUMENTS

| | | | | |
|---|---|---|---|---|
| 4,871,170 | A | 10/1989 | Carini | |
| 9,072,960 | B1 * | 7/2015 | Polk, III | A63F 7/0017 |
| 9,573,048 | B2 * | 2/2017 | Masching | A63F 7/0023 |
| 2022/0280851 | A1 * | 9/2022 | Petrarca | A63B 67/06 |
| 2022/0370871 | A1 * | 11/2022 | Richert | A63B 71/0036 |

* cited by examiner

FIG. 4 A
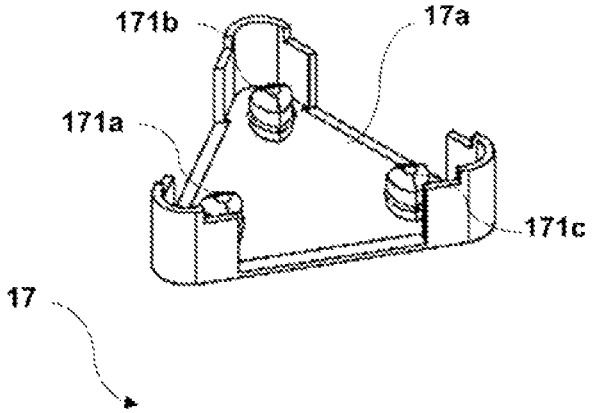
FIG. 4 B
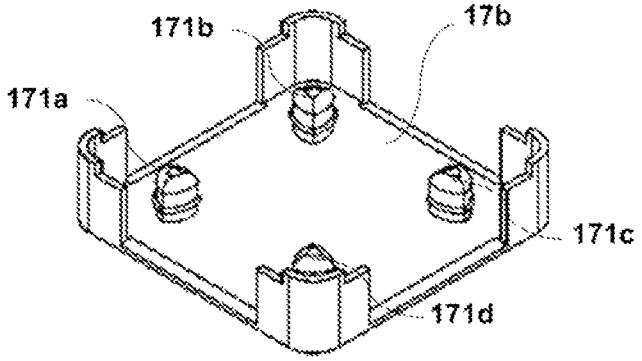
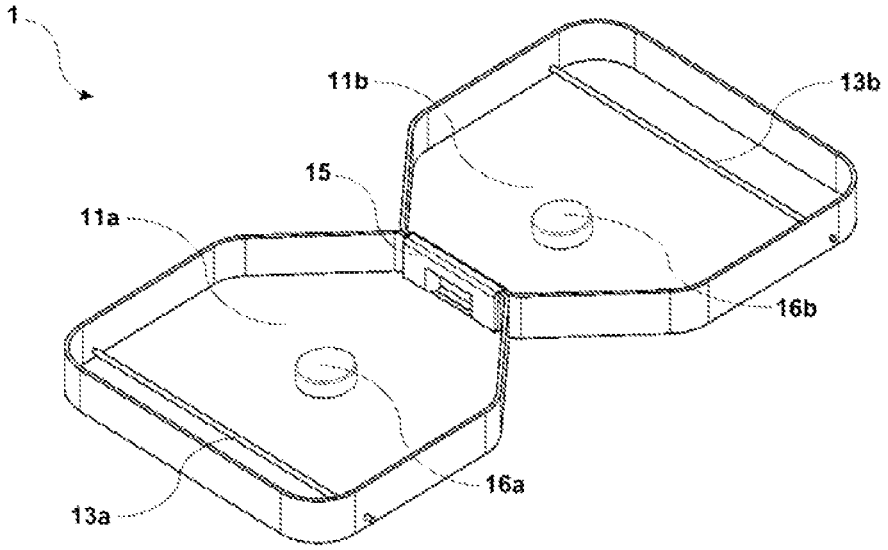
FIG. 5

SLIDING PUCK MULTIPLAYER GAME WITH ADJUSTABLE DIFFICULTY

TECHNICAL FIELD OF THE INVENTION

The present invention relates to the technical field of hockey-type table games, in particular to a game in which pucks are projected across a playing surface by means of a compression system that can be operated with the fingers of a hand and that aims to insert said pucks into a goal. Specifically, it provides a sliding puck multiplayer game having the possibility of adjusting the difficulty of the game and the number of players.

BACKGROUND OF THE INVENTION

The world of entertainment is constantly growing, however, even with the advancement of technology and the creation of new video games, classic board games, strategy and skill games are not left behind. In recent times, strongly motivated by restrictions and quarantines due to the coronavirus pandemic, these types of games have played a leading role in every home, as people have been forced to seek entertainment alternatives inside their houses.

Among the solutions described in the state of the art are, for example, what is proposed in document U.S. Pat. No. 3,954,267, which discloses a game that provides rapid and diverse game action comprising a game table having a planar playing surface and boundary walls extending thereabout of relatively rigid material, said planar playing surface having a pattern of closely spaced perforations therein, said game table further including means for supplying air under pressure and conduit means communicating with said perforations to provide jets of air issuing from said perforations; and a puck comprising a body member of relatively rigid synthetic resin and generally circular cross section having a continuous disc portion with upper and lower surfaces and with a coaxial circular recess extending upwardly in the lower surface thereof and upstanding annular wall extending upwardly from the upper surface of said disc portion and spaced inwardly from the periphery thereof to provide a horizontally disposed annular shoulder thereabout and a cavity therewithin, said annular wall having substantially vertical faces; and an annular bumper member of resiliently deformable synthetic resin seated about said annular wall and on said annular shoulder, said annular bumper member being of a width greater than the width of said shoulder so as to project outwardly of the periphery of said body member for engagement with the boundary walls of said game table.

On the other hand, document U.S. Pat. No. 4,871,170 discloses a gaming apparatus comprising a squeeze apparatus, for propelling a puck, said squeeze apparatus comprising: a pair of arms; each arm connected to the other by spring means; and said spring means connecting the arms and biasing the arms towards an acute angle to each other. Wherein said gaming apparatus further comprises puck means in the form of a cylindrical disc; and playing field means comprising: wall means suitable for bounding an area on a flat surface to define a playing surface, and goal means comprising: pedestal means, mountable in a horizontally secure fashion, in either of two opposite orientations; hinge means mounted on the pedestal means; barrier means, pivotally attached by the hinge means to the pedestal means, said barrier means oriented horizontally across a barrier side of the pedestal means, the goal means thus having a barrier side and a pedestal side, so that when said puck means collides with said barrier means from a direction on the barrier side, any motion of the barrier is halted by the pedestal means, and the puck means rebound; but if the puck means collide with said barrier means from a direction on the pedestal's side, said barrier means pivot up on their hinges and allow the puck means to pass; and bridge means, joining said pedestal means across the top of said pedestal means; said pedestal means comprising a plurality of pedestals, an outer two of which pedestals are mountable on a wall means, across an angle formed at a corner of said playing field means However, the solutions described in the state of the art describe skill games that use sliding discs, but that allow a fixed number of players and a standard difficulty, making it quite monotonous, and not allowing to adjust the difficulty in relation to, for example, the age range of the players.

Consequently, a dynamic "Sling Puck" type of skill board game is required, but one that allows a greater number of players simultaneously and with adjustable difficulty. In addition, due to its portable and modular nature, the right and necessary number of boards may be installed depending on the number of players required, as well as offering quick and easy assembly/disassembly.

SUMMARY OF THE INVENTION

The present invention provides a sliding puck multiplayer game with adjustable difficulty, characterized in that it comprises: a polygonal-shaped modular platform having walls on each of its edges, wherein said modular platform comprises an elastic band positioned close to and parallel to its bottom wall, and a cavity positioned on the wall opposite said bottom wall; a plurality of interchangeable connector bridges of different sizes that are connected to said modular platform in said cavity, where said connector bridges allow, in addition, to link two or more modular platforms facing each other; and a plurality of sliding pucks that are propelled by the effect of said elastic band, to go through said connecting bridges.

In a preferred embodiment, the sliding puck multiplayer game with adjustable difficulty is characterized in that said modular platform is in the shape of a hexagon.

In another preferred embodiment, the sliding puck multiplayer game with adjustable difficulty is characterized in that said modular platform and its walls are made of a rigid material.

In another preferred embodiment, the sliding puck multiplayer game with adjustable difficulty is characterized in that said modular platform and its walls are made of plastic.

In a further preferred embodiment, the sliding puck multiplayer game with adjustable difficulty is characterized in that said elastic band is connected firmly to the lateral walls of said modular platform.

In another preferred embodiment, the sliding puck multiplayer game with adjustable difficulty is characterized in that it allows to link a plurality of modular platforms facing each other.

In another preferred embodiment, the sliding puck multiplayer game with adjustable difficulty is characterized in that it allows to link three modular platforms facing each other, by means of a triangular connecting element.

In another preferred embodiment, the sliding puck multiplayer game with adjustable difficulty is characterized in that it allows to link four modular platforms facing each other, by means of a quadrangular connecting element.

In another preferred embodiment, the sliding puck multiplayer game with adjustable difficulty is characterized in that each pair of modular platforms have slightly different sizes, in order to nest them inside one another.

In a further preferred embodiment, the sliding puck multiplayer game with adjustable difficulty is characterized in that the diameter of each of the sliding pucks that form said plurality of sliding pucks is smaller than the size of the arch that defines each connecting bridge that forms said plurality of connecting bridges.

BRIEF DESCRIPTION OF THE FIGURES

FIGS. 4A and 4B show isometric views of two preferred embodiments of the connecting elements for a plurality of platforms that form part of the sliding puck multiplayer game with adjustable difficulty that is the object of the present invention.

FIG. 5 shows an isometric view of a first embodiment of a sliding puck multiplayer game with adjustable difficulty that is the object of the present invention.

DETAILED DESCRIPTION OF THE INVENTION

Figure 1:
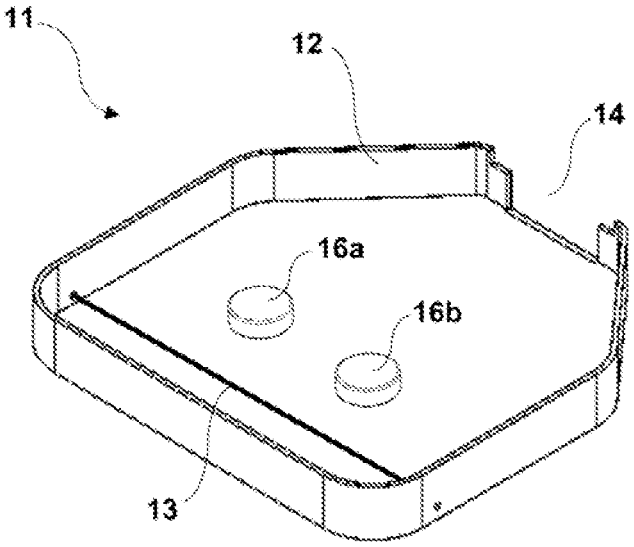
FIG. 1 shows an isometric view of a preferred embodiment of the modular platform that is part of the sliding puck multiplayer game with adjustable difficulty that is the object of the present invention.

Essentially, the present invention provides a sliding puck multiplayer game (1) with adjustable difficulty comprising: a modular platform (11) of polygonal shape having walls (12) on each of its edges, wherein said modular platform (11) comprises an elastic band (13) positioned close to and parallel to its bottom wall, and a cavity (14) positioned on the wall opposite said bottom wall; a plurality of interchangeable connecting bridges (15*a*, 15*b*) of different sizes that are connected to said modular platform (11) in said cavity (14), wherein said connecting bridges (15*a*, 15*b*) also allow linking two or more modular platforms (11*a*, 11*b*) facing each other; and a plurality of sliding pucks (16*a*, 16*b*, 16*c*) that are propelled by the effect of said elastic band (13), to cross said connecting bridges (15*a*, 15*b*).

In the context of the present invention, without limiting the scope of protection, "modular" is understood as an element that can be easily articulated and disarticulated, and that is particularly versatile, since it allows to vary its position with respect to the other elements that are articulated.

The geometry of the modular platform (11) having a polygonal shape does not limit the scope of the present invention. It can be, for example, a triangle, a square, a pentagon, among others. In a preferred embodiment, and without limiting the scope of protection, the modular platform (11) has a hexagonal shape, as shown in FIG. 1.

On the other hand, the material of said modular platform (11) and its walls (12) do not limit the scope of the present invention. In a particularly advantageous embodiment, the material of said modular platform (11) and its walls (12) is a rigid material, selected from the group consisting of: cardboard, plastic, metal, glass, wood. It may also be a mixture of some of the materials listed above. In a preferred embodiment, and without limiting the scope of protection, the modular platform (11) and its walls (12) are made of plastic. Additionally, the sizes of said modular platform (11) and its walls (12) do not limit the scope of the present invention. In a preferred embodiment, and without limiting the scope of protection, each of the edges of the hexagon of said modular platform (11) measures between 10 centimeters and 30 centimeters, with a thickness of between 0.2 centimeters and 1 centimeter. In an even more preferred embodiment, and without limiting the scope of protection, each of the edges of the hexagon of said modular platform (11) measures 20 centimeters, with a thickness of 0.5 centimeters. With respect to the walls (12), the length is limited by the sizes of each of the edges of the hexagon of said modular platform (11). In a preferred embodiment, and without limiting the scope of protection, the height of each of the walls (12) measures between 1 centimeter and 10 centimeters, with a thickness of between 0.2 centimeters and 1 centimeter. In an even more preferred embodiment, and without limiting the scope of protection, the height of each of the walls (12) measures 3 centimeters, with a thickness of 0.5 centimeters.

In the context of the present invention, without limiting the scope of protection, an "elastic band" will be understood as a thin and long element that has the capacity of recovering its original sizes once it is subjected to a mechanical force that causes a change in its shape.

The material of the elastic band (13) does not limit the scope of the present invention. In a particularly advantageous embodiment, and without limiting the scope of protection, the elastic band (13) is made of a flexible material, selected from the group consisting of: elastin, rubber or any rubber-like material, nylon, latex, wool, silicone. It may also be a mixture of some of the materials listed above. In a preferred embodiment, and without limiting the scope of protection, the elastic band (13) is a rubber band. The sizes of said elastic band (13) do not represent a limiting characteristic; the length of the elastic band (13) is limited by the length of the edges of the hexagon of the modular platform (11). In a preferred embodiment, and without limiting the scope of protection, the elastic band (13) has a length of between 15 centimeters and 35 centimeters, with a diameter of between 0.1 centimeters and 1 centimeter. In an even more preferred embodiment, and without limiting the scope of protection, the elastic band (13) has a length of 25 centimeters, with a diameter of 0.3 centimeters.

In the context of the present invention, a "firm connection" will be understood as a connection between two or more elements, which stays firm during the game session, so that said elements cannot move or become detached until the players decide to modify the difficulty setup.

The elastic band (13) is positioned close to and parallel to the bottom wall of the modular platform (11), being connected firmly to the side walls of the same. The way of connecting firmly said elastic band (13) to the side walls of said modular platform (11) does not limit the scope of the present invention; it can be, for example: through a glue, staples, through a stop element, nailed or bolted, among others. In a preferred embodiment, and without limiting the scope of protection, the elastic band (13) is connected firmly to the side walls of said modular platform (11) in a through way and knotting the excess material, wherein said knot functions as stop element. The distance between said elastic band (13) and the bottom wall of said modular platform (11) does not limit the scope of the present invention. In a preferred embodiment, and without limiting the scope of protection, the distance between said elastic band (13) and the bottom wall of said modular platform (11) is between 2 centimeters and 10 centimeters. In an even more preferred embodiment, and without limiting the scope of protection, the distance between said elastic band (13) and the bottom wall of said modular platform (11) is 4 centimeters. On the other hand, the height between said elastic band (13) and the surface of said modular platform (11) is limited by the height of each of the sliding pucks that form said plurality of sliding pucks (16*a*, 16*b*, 16*c*). In a preferred embodiment, and without limiting the scope of protection, the height between said elastic band (13) and the surface of said modular platform (11) is 0.5 centimeters. Additionally, the modular platform (11) comprises a cavity (14) positioned in the wall opposite said bottom wall. The shape, location, and sizes of said cavity (14) do not limit the scope of the present invention. In a preferred embodiment, and without limiting the scope of protection, the cavity (14) has a rectangular shape and is located centered on the wall opposite said bottom wall, it has a length between 8 centimeters and 28 centimeters, and is complete with respect to the height, that is, it has a height equal to the height of said wall. In an even more preferred embodiment, and without limiting the scope of protection, the cavity (14) has a length of 15 centimeters and a height of 3 centimeters.

Figure 2:
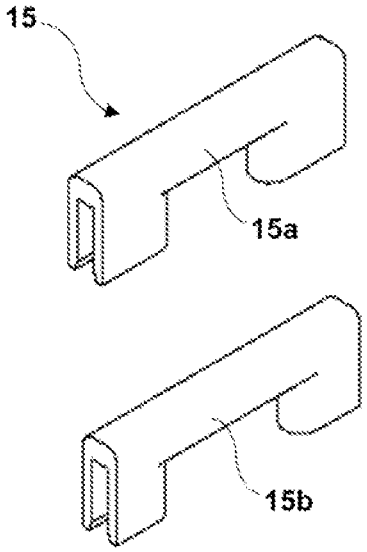
FIG. 2 shows an isometric view of a preferred embodiment of the connecting bridges that are part of the sliding puck multiplayer game with adjustable difficulty that is the object of the present invention.

In the cavity (14) of the modular platform (11) a connecting bridge (15) is connected, which is selected from a plurality of interchangeable connecting bridges (15*a*, 15*b*), wherein said connecting bridges define arches of different sizes, that is, the size of the arches that define said connecting bridges (15*a*, 15*b*) are variable and do not limit the scope of the present invention, as shown in FIG. 2. It could be, for example, an arch of 4 centimeters long and 2 centimeters high, and another arch of 6 centimeters long and 2 centimeters high. The material of each of the connecting bridges (15) that form said plurality of connecting bridges (15*a*, 15*b*) does not limit the scope of the present invention. In a preferred embodiment, and without limiting the scope of protection, each of the connecting bridges (15) that form said plurality of connecting bridges (15*a*, 15*b*) are made of plastic. The sizes of each of the connecting bridges (15) that form said plurality of connecting bridges (15*a*, 15*b*) also do not limit the scope of the present invention. However, in a particularly advantageous embodiment, the size of said connecting bridges coincides with the size of the walls of the hexagon of the modular platform (11). In a preferred embodiment, and without limiting the scope of protection, it has a length of 20 centimeters and a height of 3 centimeters.

Figure 3:
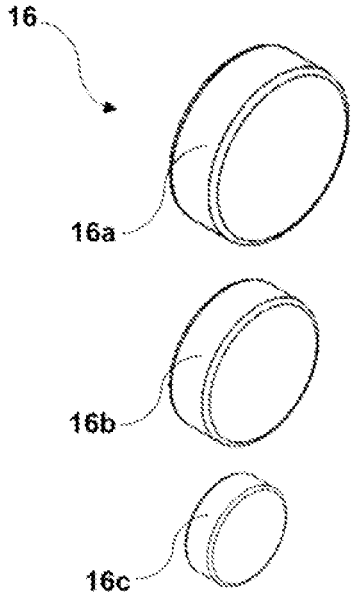
FIG. 3 shows an isometric view of a preferred embodiment of a sliding puck that is part of the sliding puck multiplayer game with adjustable difficulty that is the object of the present invention.

In the context of the present invention, and without limiting the scope of the present invention, "sliding puck" will be understood as a cylindrical body whose base is considerably greater than its height, as shown in FIG. 3, and that it is intended to slide or slip along the surface that contains it.

The material of said plurality of sliding pucks (16*a*, 16*b*, 16*c*) does not represent a limiting characteristic for the present invention. However, in a particularly advantageous embodiment, said plurality of sliding pucks (16*a*, 16*b*, 16*c*) are made of a material exhibiting high toughness, that is, that are capable of withstanding impacts or collisions without breaking. It can be, for example, steel, copper, iron, wood, plastics, concrete. It may also be a mixture of some of the materials listed above. In a preferred embodiment, and without limiting the scope of protection, said plurality of sliding pucks (16*a*, 16*b*, 16*c*) are made of plastic. On the other hand, the sizes of said plurality of sliding pucks (16*a*, 16*b*, 16*c*) do not limit the scope of the present invention either. As mentioned above, the height must be greater than the height where the elastic band (13) is connected firmly to the side walls of the modular platform (11). And the diameter is limited by the size of the arch that defines the connecting bridge (15), and each of said sliding pucks (16) that form said plurality of sliding pucks (16*a*, 16*b*, 16*c*) may also be identical to each other, or of variable diameter. In a preferred embodiment, and without limiting the scope of protection, said plurality of sliding pucks (16*a*, 16*b*, 16*c*) are identical to each other and have a height of between 1 centimeter and 3 centimeters, and a diameter of between 2 centimeters and 5 centimeters. In an even more preferred embodiment, and without limiting the scope of protection, said plurality of sliding pucks (16*a*, 16*b*, 16*c*) have a height of 1 centimeter and a diameter of 3 centimeters.

Wherein said connecting bridges (15*a*, 15*b*), also allow to link two or more modular platforms (11*a*, 11*b*) facing each other. In order to link more than two modular platforms (11), a connecting element (17) is additionally provided. The material of said connecting element (17) does not limit the scope of the present invention. In a preferred embodiment, and without limiting the scope of protection, said connecting element (17) is made of plastic. The shape of said connecting element is limited by the number of modular platforms (11) to be linked. In order to link three modular platforms (11*a*, 11*b*, 11*c*) facing each other, said connecting element (17*a*) has a triangular shape, as shown in FIG. 4A. In order to link four modular platforms (11*a*, 11*b*, 11*c*, 11*d*) facing each other, said connecting element (17*b*) has a quadrangular shape, as shown in FIG. 4B. The sizes of said connecting elements (17*a*, 17*b*) are limited by the size of the edges of the hexagon of said modular platform (11) and said connecting bridges (15*a*, 15*b*). In a preferred embodiment, and without limiting the scope of protection, each of the edges of said connecting elements (17*a*, 17*b*) is 20 centimeters. Said connecting elements (17*a*, 17*b*) comprise on their surface a plurality of pivot pins (171*a*, 171*b*), where each of the sliding pucks (16) bounce to propel them to a rival modular platform (11). The quantity of pivot pins (171*a*, 171*b*) present in said connecting elements (17*a*, 17*b*), does not limit the scope of the present invention. In a preferred embodiment, and without limiting the scope of protection, said connecting element (17*a*) comprises 3 pivot pins (171*a*, 171*b*, 171*c*), and said connecting element (17*b*) comprises 4 pivot pins (171*a*, 171*b*, 171*c*, 17*d*). In another preferred embodiment, and without limiting the scope of the protection, said connecting elements (17*a*, 17*b*) have a small drop in height, as shown in FIG. 4A and FIG. 4B. Wherein said small drop in height is intended avoid a possible mismatch of heights when coupling said modular platforms (11*a*, 11*b*, 11*c*, 11*d*), said connecting elements (17*a*, 17*b*), and said connecting bridges (15*a*, 15*b*), which can generate a problem for the passage of said sliding pucks (16*a*, 16*b*).

In the context of the present invention, and without limiting the scope of protection, it will be understood as "nest" the action of internally coupling one part inside another.

In a particularly advantageous embodiment, and without limiting the scope of protection, each pair of modular platforms (11*a*, 11*b*) or (11*c*, 11*d*) chosen from said plurality of modular platforms (11*a*, 11*b*, 11*c*, 11*d*) have slightly different sizes, so that they can be nested inside one another, thus being able to store a modular platform inside the other, generating a much more compact storage.

The advantage of the multiplayer game (1) with respect to the state of the art is that, depending on the number of players required, the number of modular platforms (11) necessary to play are connected. This also allows to adjust the difficulty of the game, through the different sizes of the connecting bridges (15), depending on the ability of the players, that is, if the players are children, it is advisable to use connecting bridges (15) with larger arches; or, if the players are adults with a higher degree of expertise, it is recommended to use connecting bridges (15) with smaller arches. Similarly, the difficulty can be adjusted, providing different diameters of sliding pucks (16).

Regarding the operation of the multiplayer game (1), a determined number of sliding pucks (16) are provided in each of the modular platforms (11) positioned opposite each other. Each of the players propel said sliding pucks (16) through the action of the elastic band (13), which is tightened by the fingers of each player's hands or any other element to pull the elastic band back. The objective is for each of the sliding pucks to cross the arches defined by said connecting bridges (15), sending them to the rival modular platform (11). The winner, without limiting the scope of the present invention, is the player who manages to get rid of all the sliding pucks (16), leaving his or her modular platform (11) empty.

EXAMPLES OF EMBODIMENTS

In a first embodiment of the sliding puck multiplayer game (1) with adjustable difficulty, and without limiting the scope of the present invention, the multiplayer game (1) comprises two modular platforms (11*a*, 11*b*) connected facing each other by means of a connecting bridge (15) coincidentally positioned in the joint between both cavities of said two modular platforms (11*a*, 11*b*), as shown in FIG. 5.

Figure 6:
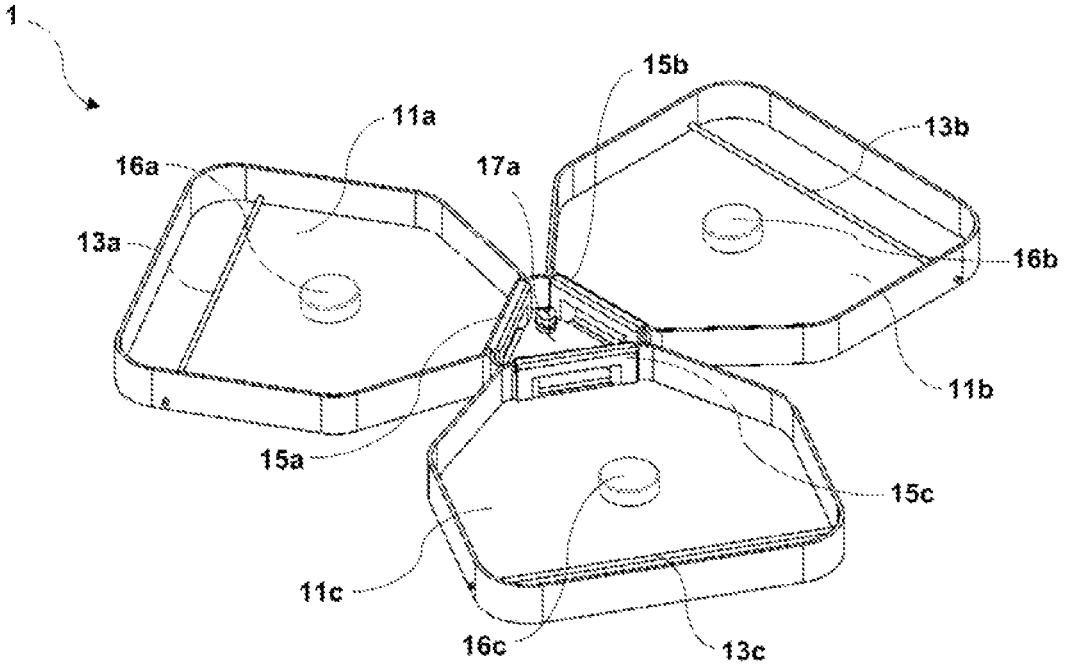
FIG. 6 shows an isometric view of a second embodiment of a sliding puck multiplayer game with adjustable difficulty that is the object of the present invention.

In a second embodiment of the sliding pucks multiplayer game (1) with adjustable difficulty, and without limiting the scope of the present invention, the multiplayer game (1) comprises three modular platforms (11*a*, 11*b*, 11*c*) connected facing each other by means of a triangular connecting element (17*a*) and three connecting bridges (15*a*, 15*b*, 15*c*), each one of them coincidentally positioned in the joint between the respective cavities of said modular platforms (11*a*, 11*b*, 11*c*) and said joining element triangular (17*a*), as shown in FIG. 6.

Figure 7:
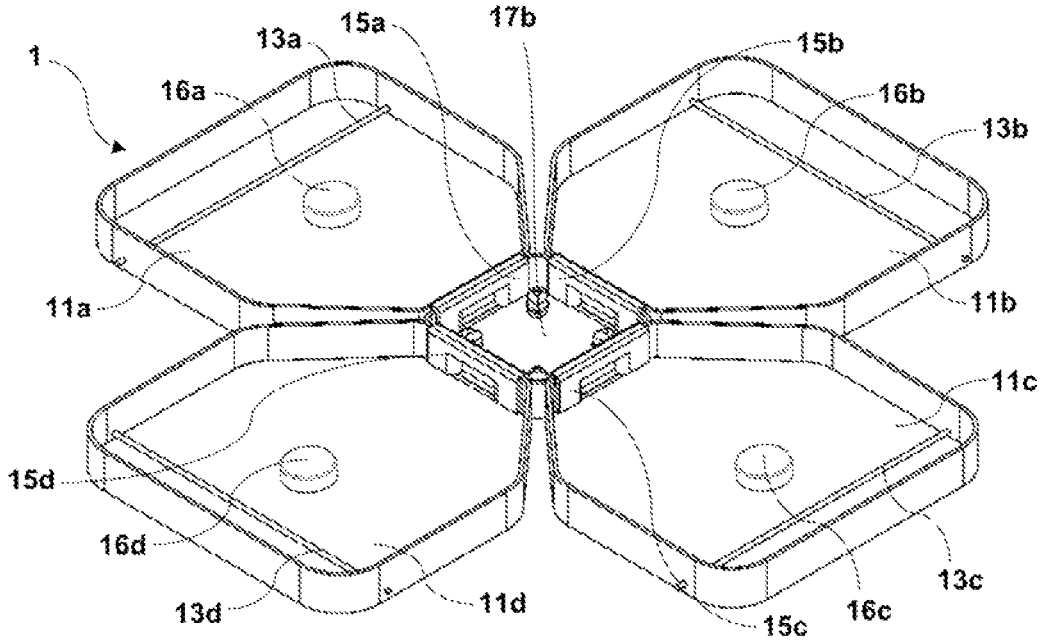
FIG. 7 shows an isometric view of a third embodiment of a sliding puck multiplayer game with adjustable difficulty that is the object of the present invention.

In a third embodiment of the sliding puck multiplayer game (1) with adjustable difficulty, and without this limiting the scope of the present invention, the multiplayer game (1) comprises four modular platforms (11*a*, 11*b*, 11*c*, 11*d*) connected facing each other by means of a quadrangular connecting element (17*b*) and four connecting bridges (15*a*, 15*b*, 15*c*, 15*d*), each one of them coincidentally positioned in the joint between the respective cavities of said modular platforms (11*a*, 11*b*, 11*c*, 11*d*) and said quadrangular connecting element (17*b*), as shown in FIG. 7.

The invention claimed is:

1. A sliding puck multiplayer game (1) with adjustable difficulty, CHARACTERIZED in that it comprises: a modular platform (11) of polygonal shape that has walls (12) on each of its edges, wherein said modular platform (11) comprises an elastic band (13) positioned close to and parallel to its bottom wall, and a cavity (14) positioned on the wall opposite said bottom wall; a plurality of interchangeable connecting bridges (15*a*, 15*b*) of different sizes that are connected to said modular platform (11) in said cavity (14), wherein said connecting bridges (15*a*, 15*b*) also allow linking two or more modular platforms (11*a*, 11*b*) facing each other; and a plurality of sliding pucks (16*a*, 16*b*, 16*c*) that are propelled by the effect of said elastic band (13), to go through said connecting bridges (15*a*, 15*b*).

2. The multiplayer game (1) according to claim 1, CHARACTERIZED in that said modular platform (11) is in the shape of a hexagon.

3. The multiplayer game (1) according to claim 1, CHARACTERIZED in that said modular platform (11) and its walls (12) are made of a rigid material.

4. The multiplayer game (1) according to claim 3, CHARACTERIZED in that said modular platform (11) and its walls (12) are made of plastic.

5. The multiplayer game (1) according to claim 1, CHARACTERIZED in that said elastic band (13) is connected firmly to the side walls of said modular platform (11).

6. The multiplayer game (1) according to claim 1, CHARACTERIZED in that it allows connecting a plurality of modular platforms (11*a*, 11*b*) facing each other.

7. The multiplayer game (1) according to claim 6, CHARACTERIZED in that it allows linking three modular platforms (11*a*, 11*b*, 11*c*) facing each other, by means of a triangular connecting element (17*a*).

8. The multiplayer game (1) according to claim 6, CHARACTERIZED in that it allows linking four modular platforms (11*a*, 11*b*, 11*c*, 11*d*) facing each other, by means of a quadrangular connecting element (17*b*).

9. The multiplayer game (1) according to claim 8, CHARACTERIZED in that each pair of modular platforms (11*a*, 11*b*) or (11*c*, 11*d*) have slightly different sizes in order to nest them inside one another.

10. The multiplayer game (1) according to claim 1, CHARACTERIZED in that the diameter of each of the sliding pucks (16) that form said plurality of sliding pucks (16*a*, 16*b*, 16*c*) is smaller than the size of the arch that defines each bridge connector (15) forming said plurality of connecting bridges (15*a*,15*b*).

* * * * *